United States Patent [19]

Wetzel et al.

[11] 3,932,854

[45] Jan. 13, 1976

[54] APPARATUS FOR THE DETECTION OF BREAKS IN MOVING THREADLINES

[75] Inventors: Wolfgang Wetzel, Landau; Manfred Müller, bad Mingolsheim, both of Germany

[73] Assignee: Imperial Chemical Ind. (Europa) Fibres, Ostringen, Germany

[22] Filed: May 8, 1972

[21] Appl. No.: 251,732

[30] Foreign Application Priority Data

May 18, 1971 Germany ..... 2124693

[52] U.S. Cl. ..... 340/259; 73/160

[51] Int. Cl.[2] ..... G08B 21/00

[58] Field of Search ..... 73/160, 159; 242/47.09, 242/48, 49; 340/259, 263; 200/61.17; 324/161, 167, 166

[56] References Cited

UNITED STATES PATENTS

| | | | |
|---|---|---|---|
| 2,739,276 | 6/1973 | Dornberger | 324/161 |
| 2,883,733 | 4/1959 | Notarbartulo | 242/47.09 |
| 3,020,621 | 2/1962 | Sacks | 242/47.09 |
| 3,456,187 | 7/1969 | Schmidt | 324/167 |

FOREIGN PATENTS OR APPLICATIONS

| | | |
|---|---|---|
| 1,132,742 | 11/1968 | United Kingdom |

*Primary Examiner*—S. Clement Swisher
*Assistant Examiner*—Denis E. Corr
*Attorney, Agent, or Firm*—Herbert M. Adrian, Jr.

[57] ABSTRACT

An apparatus and method for detecting breaks in a travelling threadline of a synthetic filament is described. The motion of the threadline is monitored for speed by means of generating an electrical current by passage of the threadline across an idler roll. Increases or decreases in the speed of the threadline change the frequency of the electrical current generated, thereby providing means for signaling threadline speed changes such as occur in breaks and wrapping of the threadline.

19 Claims, 4 Drawing Figures

APPARATUS FOR THE DETECTION OF BREAKS IN MOVING THREADLINES

The present invention relates to an apparatus for the detection of breaks in travelling threadlines and is particularly concerned with yarn and fibre processing machinery. The detection of breaks in threadlines is known to be necessary for the protection and control of fibre processing and machinery. However, the methods which have previously been used have either involved routine inspection which is costly or elaborate optical or mechanical methods which are both expensive and have at times proved unreliable and insufficiently sensitive.

It is an aim of the present invention to provide a comparatively simple technique for sensing breaks in travelling threadlines which preferably does not involve any additional contact with the threadline. In yarn and fibre processing it is common practice to use rotating rolls to control the speed at which yarn is travelling. For example yarn is generally drawn between two pairs of rolls, one pair operating at a greater peripheral speed than the other. Similarly when yarn is texturised it is generally treated while passing between two rolls or pairs of rolls. In these processes it is important that the yarn be subjected to a uniform treatment and thus the yarn must be under constant tension and not slip as it passes around the rolls and it is common practice to pass the yarn several times between the processing roll and an idler roll situated close thereto, which is driven by the motion of the yarn. Frequently the axis of this idler roll is inclined to the axis of the processing roll to ensure that the various strands that pass between it and the processing roll remain separate and do not become entangled.

Fibre processing machines of the type described above require constant supervision to ensure that when the yarn breaks the machine does not continue in operation, causing the loose end to wind onto the roll. An object of the present invention is therefore to provide a device which automatically senses a break in a travelling thread and emits a signal irrespective of where the break in the threadline occurs. In a preferred embodiment the signal also actuates a device which interrupts the thread supply.

According to the present invention we provide a device for detecting a break in a travelling threadline comprising a driven roll and an idler roll between which the threadline passes said idler roll being driven by the motion of the thread and means are provided to monitor the speed of rotation of the idler roll wherein said means emits a signal when said speed varies by at least a pre-determined amount, thus indicating a break in the threadline.

The process of the present invention has two principal advantages. Firstly in many instances it is not necessary to add additional rolls to standard fibre processing machinery because as already mentioned it is common practice to control the speed of a threadline by passing it round a driven roll and to minimise slippage on the driven roll by passing the yarn several times between the driven roll and an idler roll. Thus, standard apparatus may be modified to operate the present invention without any need to provide additional means in contact with the yarn to sense breaks. An added advantage of the present invention is that a break in the threadline is detected irrespective of the side of the driven roll it occurs. If the thread breaks before it reaches the driven roll the speed of rotation of the idler roll falls as it is no longer driven by the movement of the thread. If, however, the thread breaks after it has passed the driven rolls, the thread is quickly wound on the driven roll, thus increasing the effective diameter of the roll which in turn increases the speed of rotation of the idler roll. Thus any variation in the speed of rotation indicates a break in the threadline. The size of the idler roll is not critical but we prefer that it be of diameter such that for the normal threadline speeds the speed of rotation of the idler roll is several revolutions per minute.

In a preferred embodiment of the present invention the means which monitors the speed of rotation of the idler roll is more sensitive to increases in the speed of rotation than to decreases in the speed. This is particularly useful because the rate of increase in the speed of rotation of the idler roll is generally smaller when a break occurs beyond the driven roll than the rate of decrease of the speed when a break occurs before the driven roll. Accordingly, we prefer to use a means which can be adjusted to give the required sensitivity to both increases and decreases in speeds of rotation.

As previously mentioned it is standard practice to minimise slippage of yarn as it passes around a driven roll by passing the yarn several times between the driven roll and and idler roll. In this type of process the idler roll is frequently known as a separator roll as in many instances it is mounted so that its axis is not parallel to the axis of the driven roll to ensure that the various yarn paths between the two rolls do not intertwine. We have found that the process of the present invention may be readily operated by monitoring the speed of rotation of this separator roll and that the standard processing machinery may readily be modified to enable this to be done.

Any suitable method may be used to monitor the speed of rotation of the idler roll. We prefer, however, to employ a method in which an alternating current is generated by the rotation of the idler roll. For example, a photocell or magnetic sensor may be used but our preferred method is to fit two small magnets onto the separator roll assembly with a coil near to them, so that the changes in the magnetic field due to rotation of the idler roll produce an alternating electric current in the induction coil. The frequency of this current is dependent on the frequency of changes in the magnetic field which is in turn dependent on the speed of rotation of the idler roll. Another and more preferred method of generating an alternating electric current is to mount two magnets on a fixed member close to a rotating part of the idler roll; these two magnets are joined by a ferromagnetic rod around which is wound an induction coil. In this way any change in mangetic flux along the ferromagnetic rod generates a current in the induction coil. A series of ferromagnetic poles are then situated regularly around the idler roll, the spacing of these poles being such that two adjacent poles will coincide with the two magnets. Thus, as the roll rotates the ferromagnetic poles on the roll will progressively be in register and out of register with the magnets. When they are in register a strong magnetic field will be set up through the magnets, the ferromagnetic rod, the ferromagnetic poles on the roll and the roll itself. The field will however be considerably weaker when the poles are out of register with the magnets. Thus, in this way the rotation of the roll sets up a variable magnetic field which is transformed into an alternating current in the induction coil. The frequency of this current depends on the speed of rotation of the roll and the number of poles situated around the roll.

When the method of detection is to set up an alternating current based on the speed of rotation of the roll we prefer that the alternating current so generated ($f_1$) is amplified and combined with a second alternating current ($f_2$) which may be provided by any type of local oscillator circuit whose frequency is set according to the normal speed of the threadline and the desired sensitivity of the detector to changes in speed of rotation of the idler roll. The combination of these two frequencies produces two frequencies, one being the sum of the two and the other the difference between the two. Both these combined frequencies are then fed to a tuning or resonance circuit which can be pre-set to select only a chosen input frequency, namely the resonance frequency of the resonance circuit, all other frequencies being rejected. Accordingly, an electric signal is generated by the tuning circuit only when this pre-set resonance frequency is applied and this electrical signal can be amplified and caused to operate the alarm and yarn interruption systems. As described, any variation in rotation of the idler roll sets up both the sum and difference frequencies in the detector circuit and thus this resonance frequency can be generated when the speed of the idler roll is greater or less than that of the reference local oscillator frequency. The detector can therefore signal both increases and decreases in the speed of the idler rolls, thus indicating thread breaks either side of the driven roll. The relative sensitivity of the device to increases or decreases in idler roll speed may be determined by the control frequency supplied by the local oscillator circuit. For example, the control frequency may be set so that the resonance frequency of the circuit is reached by a larger reduction in the speed of roll rotation but a smaller increase or vice versa.

The nature of the alarm signal may be chosen to suit requirements, for instance the signal may sound a bell or illuminate a light to indicate that there has been a break in a threadline. Alternatively, and as is preferred, the alarm signal activates a cutter which severs the threadline at its feed and may simultaneously illuminate a warning light.

The present invention is illustrated but in no way limited by reference to the accompanying drawings in which FIG. 1 illustrates the roll system of the present invention;

FIG. 2 gives a more detailed illustration of the separator roll;

Figure 1:
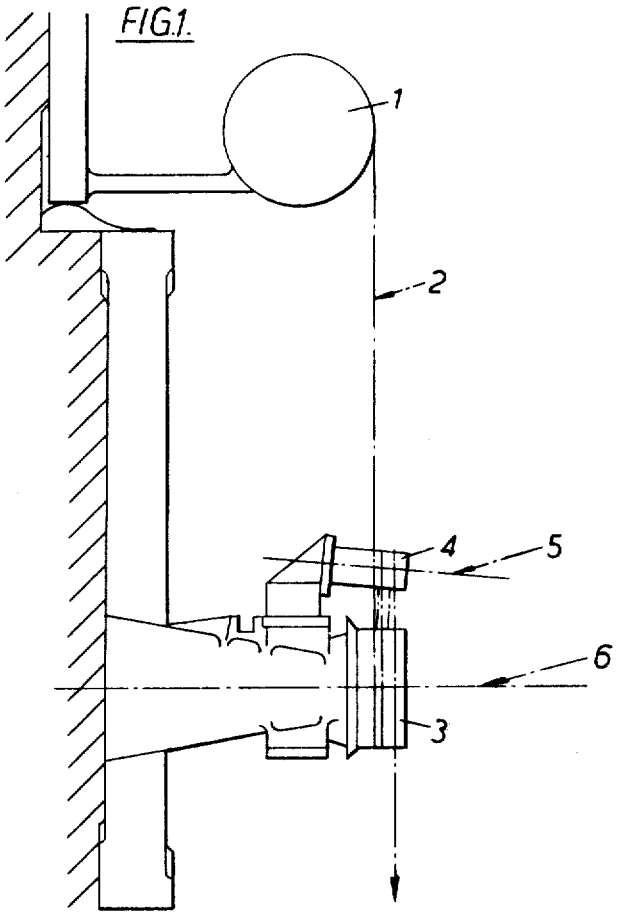

Referring to FIG. 1 the apparatus consists of a feed roll 1 which supplies the threadline 2 to the driven galette roll 3. A separator roll 4 is mounted close to and above the galette, with its axis 5 inclined to the axis 6 of the galette. As illustrated, the threadline 2 passes several times between the galette 3 and the separator roll 4 to minimise slippage of the thread around the galette. In this way the separator roll is driven by the motion of the thread and its speed of rotation may be monitored to detect breaks in the threadline.

Figure 2:
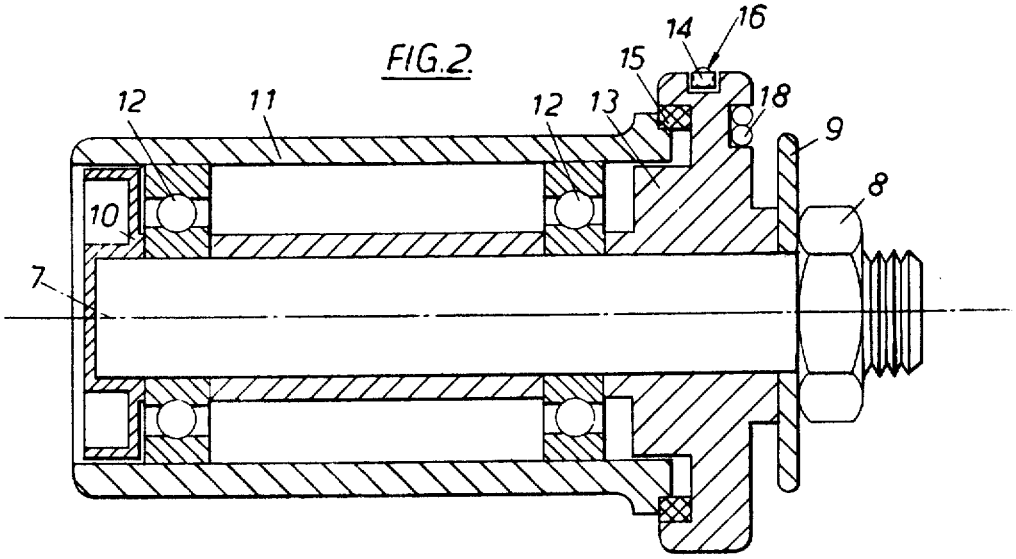
Figure 3:
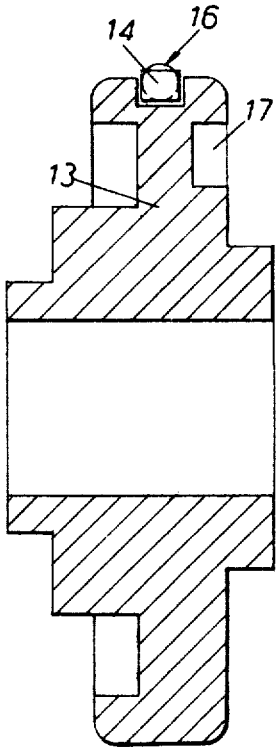
FIG. 3 shows the mounting of the magnet on the separator roll.

The construction of the separator roll 4 is shown in detail in FIG. 2. The roll is mounted on the machine on an axle 7 on which it is held by the nut 8, washer 9 and the screw 10. The outer sleeve 11 of the roller is therefore free to rotate about the axle 7 on the ball races 12. A flange 13 is also mounted on the axle 7 which is recessed to receive the end of the sleeve 11. Two magnets, one of which is shown at 14, are mounted in a recess fromed in the flange 13 and are joined by a ferromagnetic rod around which is wound an induction coil 16. The flange 13 does not rotate with the roll. The construction of flange 13 and the seating of the magnet 14 and the induction coil 16 are shown in more detail in FIG. 3.

Figure 4:
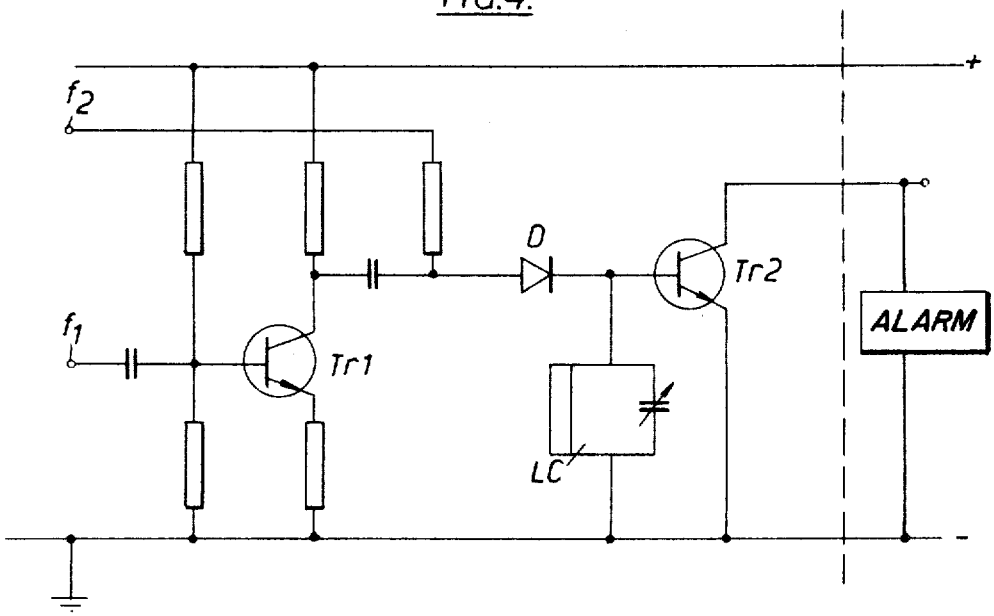
FIG. 4 is an electric circuit which is used to monitor the speed of rotation of the idler roll.

A series of ferromagnetic poles 15 are mounted at the end of the sleeve 11 and are arranged so that adjacent poles come into register with the two magnets 14 as the roll rotates. Thus when the roll rotates poles 15 successively come into and out of register with the pair of magnets 14 thus setting up a fluctuating magnetic flux along the ferromagnetic rod joining the magnets 14. This in turn creates an alternating current of frequency $f_1$ in the coil 16 which lies in the magnetic field. The terminals 18 which are seated in a groove 17 formed in the flange 13 are connected to the coil 16 and feed the current $f_1$ to the detection circuit illustrated in FIG. 4. In this circuit the current due to the frequency of rotation of the separator roll $f_1$ is first amplified by the transistor $Tr_1$ and then combined with a standard frequency $f_2$ at the Diode D. The diode transmits the combination of $f_1$ and $f_2$ so that, in particular, frequencies corresponding to $(f_1 - f_2)$ or $f_2 - f_1)$ are fed to the resonance circuit LC, which is tuned to have a frequency $f_3$. By this means a signal is conducted only when $f_1 - f_2 = f_3$ or when $f_2 - f_1 = f_3$, and this signal is transmitted through the amplifying transistor $TR_2$ to activate the alarm.

The magnitudes of the local oscillator standard frequency $f_2$ and that of the resonance frequency $f_3$ may be varied to make the device more sensitive to variations in $f_1 - f_2$ or in $f_2 - f_1$, independently as required. For instance if the frequencies $f_2$ and $f_3$ are pre-set so that the frequency $f_1$ during normal running is nearer to $f_2 + f_3$ than to $f_2 - f_3$, then the device will be more sensitive to increases in idler roll speed than to decreases in it. This is particularly advantageous because when a thread break occurs beyond the galette and the thread wraps around the galette in an indesirable way, the number of revolutions of the separating roll 4 initially increases relatively slightly so in this instance it is desirable to reach the resonance frequency of the oscillatory circuit more quickly. If, however, a thread break occurs between the feed roll 1 and the galette 3, then the number of revolutions of the separating roll 4 falls quickly to the value zero which results in an almost jumplike change in the frequency $f_1$. Thus, even with a damped system the resonance frequency $(f_2 - f_1)$ is reached practically without any loss in time when a break occurs beyond the galette. The oscillatory circuit LC itself need not be of a high quality and we have found that a relatively flat resonance curve suffices.

The present invention is further illustrated but in no way limited by the following example of the use of an apparatus of the type illustrated in the accompanying drawings. When the machine was working normally the current generated by the rotation of the idler roll had a frequency of 5,000 cycles per second. It is desirable that the detector system should emit an alarm signal if this frequency either increases to 5,040 cycles per second or decreases to 3,820 cycles per second. Thus, if the local oscillator standard frequency is $f_2$ and the resonance frequency of the tuning circuit is $f_3$ they are set so that $f_2+f_3=5040$ and $f_2-f_3=3820$ which means that $f_2=4430$ cycles per second and $f_3=610$ cycles per sencond.

Thus, it may be seen from this example that the values of $f_3$ and $f_2$ may be chosen so that an alarm signal is emitted at any pre-determined combination of increase oor decrease in idler roll speed.

It should be appreciated that although the present invention has been described with reference to threadlines it is equally suited to detecting breaks in other travelling lines.

We claim:

1. A device for detecting a break in a travelling threadline comprising a driven roll and an idler roll between which the threadline passes, said idler roll being driven by the motion of the thread and means to monitor the speed of rotation of the idler roll wherein said means emits a signal when said speed varies by at least a pre-determined amount thus indicating a break in the threadline, wherein said idler roll itself provides a means to monitor its speed of rotation by generating an alternating current by the rotation of the idler roll, the frequency of said current being dependent on the speed of rotation of the roll so that the speed of rotation may be monitored by monitoring the frequency of the alternating current wherein the alternating current generated by the idler roll is combined with a standard frequency and fed to a tuner which is tuned to respond to a pre-determined difference between the input frequency and the standard frequency.

2. A device according to claim 1 in which the signal is emitted either when the speed of rotation increases or decreases by a pre-determined amount.

3. A device according to claim 2 in which the pre-determined amount of increase is different in magnitude from the pre-determined decrease.

4. A device according to claim 1 in which the threadline passes several times between the driven roll and the idler roll and the axis of the idler roll is inclined to the axis of the driven roll.

5. A device according to claim 1 in which the idler roll itself provides the means to monitor its speed of rotation.

6. A device according to claim 5 in which means are provided whereby an alternating current is generated by the rotation of the idler roll, the frequency of said current being dependent on the speed of rotation of the roll so that the speed of rotation may be monitored by monitoring the frequency of the alternating current.

7. A device according to claim 6 wherein one or more magnets are mounted to rotate with the idler roll and an induction coil is mounted to transform the magnetic field generated by the magnet to an alternating current so that variations in the speed of rotation of the idler roll are shown by the variations in the frequency of the current.

8. A device according to claim 1 which emits a warning signal when the combined frequency becomes equal to the tuner frequency.

9. A device according to claim 8 in which the warning signal interrupts the yarn feed to the idler roll.

10. A device according to claim 8 in which the signal transmitted by the tuner activates a cutter to sever the yarn feed.

11. A process for the detection of breaks in travelling threadlines comprising passing the threadline between a driven roll and an idler roll, said idler roll being driven by the motion of the threadline, said idler roll generating electrical current based on the speed of rotation of said idler roll, monitoring the speed of rotation of the idler roll by monitoring the current generated, said monitoring being effected by combining the generated current with a standard electrical frequency and feeding the combination to a resonance circuit tuned to respond to a pre-determined frequency, thereby detecting pre-determined increases or decreases in roll speed.

12. A process according to claim 11 wherein when the speed of rotation of the idler roll varies by a pre-determined amount an alarm signal is emitted.

13. A process according to claim 12 in which the alarm signal is emitted by either a pre-determined increase or a pre-determined decrease in speed of rotation.

14. A process according to claim 11 in which the rotation of the idler roll generates an alternating current, the frequency of which is monitored so that variations in the frequency indicate variations in roll speed.

15. A process for the detection of breaks in travelling threadlines comprising passing the threadline between a driven roll and an idler roll which is driven by the motion of the threadline and monitoring the speed of rotation of the idler roll wherein the rotation of the idler roll generates an alternating current, the frequency of which is monitored so that variations in this frequency indicate variations in roll speed, combining the generated alternating current with a current of standard frequency and feeding the combination to a resonance circuit tuned to respond to certain frequencies corresponding to pre-determined increase or decrease in roll speeds, thereby determining a break in the travelling threadline.

16. A process according to claim 15 in which the standard frequency and the resonance frequency of the resonance circuit are set so that the pre-determined increase in roll speed to which the circuit responds is less than the pre-determined decrease to which it responds.

17. The process of claim 15 wherein when the speed of rotation of the idler roll varies by a pre-determined amount, an alarm signal is emitted.

18. A process according to claim 17 in which the alarm signal is emitted by either a pre-determined increase or pre-determined decrease in speed of rotation.

19. A device for detecting a break in a travelling threadline comprising a driven roll and an idler roll between which the threadline passes, said idler roll being driven by the motion of the thread and means to monitor the speed of rotation of the idler roll wherein said means emits a signal when said speed varies by at least a pre-determined amount thus indicating a break in the threadline, wherein said idler roll itself provides a means to monitor its speed of rotation by generating an alternating current by the rotation of the idler roll, the frequency of said current being dependent on the speed of rotation of the roll so that the speed of rotation may be monitored by monitoring the frequency of the alternating current wherein the means for generating the alternating current comprises a pair of magnets separated by a ferromagnetic rod around which is wound an induction coil, said magnets being fixed and mounted close to the idler roll and a series of interconnected ferromagnetic poles are mounted around the idler roll such that adjacent poles are periodically brought into register with said magnets due to the rotation of the idler roll, and the frequency of the alternating current induced in the coil is monitored to monitor the speed of rotation of the roll.

* * * * *